US009575432B2

(12) United States Patent
Yamazaki

(10) Patent No.: US 9,575,432 B2
(45) Date of Patent: Feb. 21, 2017

(54) IMAGE FORMING APPARATUS

(71) Applicant: CANON KABUSHIKI KAISHA, Tokyo (JP)

(72) Inventor: Katsuyuki Yamazaki, Toride (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/675,993

(22) Filed: Apr. 1, 2015

(65) Prior Publication Data

US 2015/0286159 A1 Oct. 8, 2015

(30) Foreign Application Priority Data

Apr. 3, 2014 (JP) ..... 2014-077259

(51) Int. Cl.

| | |
|---|---|
| ***G03G 15/00*** | (2006.01) |
| ***G03G 15/043*** | (2006.01) |
| *B41J 2/455* | (2006.01) |
| *B41J 2/45* | (2006.01) |
| *G03G 15/04* | (2006.01) |

(52) U.S. Cl.

CPC ..... *G03G 15/043* (2013.01); *B41J 2/45* (2013.01); *B41J 2/455* (2013.01); *G03G 15/04072* (2013.01); *G03G 2215/0404* (2013.01)

(58) Field of Classification Search

CPC ..... G03G 15/04072; G03G 15/043; G03G 2215/0404

USPC ..... 399/32, 47, 51

See application file for complete search history.

(56) References Cited

U.S. PATENT DOCUMENTS

| | | | | |
|---|---|---|---|---|
| 5,586,055 | A * | 12/1996 | Ng et al. | 702/90 |
| 5,694,637 | A * | 12/1997 | Yoshino et al. | 399/38 |
| 7,852,363 | B2 * | 12/2010 | Kawamoto | 347/237 |
| 8,520,042 | B2 | 8/2013 | Kawamoto | 347/237 |
| 8,823,762 | B2 | 9/2014 | Yamazaki | 347/236 |
| 2007/0285491 | A1 * | 12/2007 | Kishimoto | 347/233 |
| 2011/0182603 | A1 | 7/2011 | Kawamoto | 399/51 |
| 2013/0286132 | A1 | 10/2013 | Yamazaki | 347/118 |
| 2015/0160582 | A1 | 6/2015 | Yamazaki | 15/43 |

FOREIGN PATENT DOCUMENTS

| | | |
|---|---|---|
| JP | 2008-089695 | 4/2008 |
| JP | 2011-173412 | 9/2011 |
| WO | 2013/161258 | 10/2013 |
| WO | 2013/161259 | 10/2013 |

* cited by examiner

*Primary Examiner* — Benjamin Schmitt

(74) *Attorney, Agent, or Firm* — Fitzpatrick, Cella, Harper & Scinto

(57) ABSTRACT

Laser driver ICs each drive different light-emitting portions and supply a driving current to one or more light-emitting portions among light-emitting portions included in a semiconductor laser. An image forming apparatus controls the laser driver ICs such that the light-emitting portions, which are each driven by a different laser driver IC, emit light beams in sequence, and measures a time interval between two BD signals generated by a BD sensor due to the light beams being incident thereon. Furthermore, based on the measured value, the image forming apparatus controls relative timings according to which the light-emitting portions emit the light beams based on image data.

12 Claims, 13 Drawing Sheets

IMAGE FORMING APPARATUS

BACKGROUND OF THE INVENTION

Field of the Invention

The present invention relates to an electrophotographic image forming apparatus.

Description of the Related Art

Conventionally, there are known to be image forming apparatuses that form electrostatic latent images on a photosensitive member by using a rotating polygonal mirror to deflect a light beam emitted from a light source and scanning the photosensitive member with the deflected light beam. This kind of image forming apparatus includes an optical sensor (beam detection (BD) sensor) for detecting the light beam deflected by the rotating polygonal mirror, and the optical sensor generates a synchronization signal upon detecting the light beam. By causing the light beam to be emitted from the light source at a timing determined using the synchronization signal generated by the optical sensor as a reference, the image forming apparatus aligns the writing start positions for the electrostatic latent image (image) in the direction (main scanning direction) in which the light beam scans the photosensitive member.

Also, there are known to be image forming apparatuses that include multiple light-emitting portions (light emitting elements) as a light source for emitting multiple light beams that each scan different lines on the photosensitive member in parallel in order to realize a higher image formation speed and higher resolution images. With this kind of multi-beam image forming apparatus, a higher image formation speed is realized by scanning multiple lines in parallel using multiple light beams, and higher resolution images are realized by adjusting the interval between the lines in the sub-scanning direction.

Japanese Patent Laid-Open No. 2008-89695 discloses an image forming apparatus that includes multiple light-emitting portions (light emitting elements) as a light source and is capable of adjusting the resolution in the sub-scanning direction by performing rotational adjustment of the light source in the plane in which the light-emitting portions are arranged. This kind of resolution adjustment is performed in the step of assembling the image forming apparatus. Japanese Patent Laid-Open No. 2008-89695 discloses a technique for suppressing misalignment in the writing start positions in the main scanning direction for the electrostatic latent image that occurs due to light source attachment errors in the assembly step. Specifically, the image forming apparatus uses a BD sensor to detect light beams emitted from a first light-emitting portion and a second light-emitting portion and generates multiple BD signals. Furthermore, the image forming apparatus sets a light beam emission time for the second light-emitting portion relative to the light beam emission time for the first light-emitting portion based on the difference in the generation times of the generated BD signals. This compensates for light source attachment errors in the assembly step and suppresses misalignment in the writing start positions for the electrostatic latent image between the light-emitting portions.

Also, with an image forming apparatus that includes multiple light-emitting portions (light emitting elements) as a light source, such as that described above, there are cases where the light-emitting portions are driven by one laser driver IC, and there are cases where the light-emitting portions are driven by multiple laser driver ICs. For example, Japanese Patent Laid-Open No. 2011-173412 proposes a method in which control states can be mutually monitored between multiple laser driver ICs, and the timing at which the laser driver ICs execute APC is controlled based on the monitoring result.

As described above, with an image forming apparatus that includes multiple light-emitting portions as a light source, in the case where the difference in the generation times of two BD signals generated by a BD sensor (BD signal time interval) is to be measured, the light power of the light beams incident on the BD sensor needs to be made constant. Usually, the response speed of the BD sensor when a light beam is incident on the BD sensor changes according to the incident light power. For this reason, if there is variation in the incident light power, on the BD sensor, of the two light beams used for measuring the time interval between the BD signals, variation will appear in the result of measuring the time interval between pulses (BD signals) generated by the BD sensor, and a measurement error can occur. Accordingly, in the case where the time interval between the BD signals is to be measured, the light power of the light beams incident on the BD sensor needs to be made constant by making the light power of the light beams emitted from the light-emitting portions constant.

However, there is a possibility that the light power of the first and second light beams emitted from the two light-emitting portions used in measurement will vary when executing the measurement of the time interval between the first and second BD signals (BD interval) due to an increase in the temperature of the laser driver IC that drives the light-emitting portions. Specifically, if the temperature of the laser driver IC differs significantly between the time of driving the first light-emitting portion that corresponds to the first BD signal, and the time of driving the second light-emitting portion that corresponds to the second BD signal, a variation will occur in the magnitudes of the driving currents supplied to the first and second light-emitting portions. This is because when the temperature of a laser driver IC increases, the driving current output from the laser driver IC decreases due to, for example, an increase in the value of the parasitic resistance in the laser driver IC.

Accordingly, when measuring the BD interval, it is necessary to make the temperature of a laser driver IC as constant as possible at the time of driving the first light-emitting portion that corresponds to the first BD signal, and at the time of driving the second light-emitting portion that corresponds to the second BD signal. In particular, in the case of driving multiple light-emitting portions using multiple laser driver ICs as in Japanese Patent Laid-Open No. 2011-173412, in order to suppress a difference between the driving currents supplied to the first and second light-emitting portions used in measuring the BD interval, driving control of the light-emitting portions needs to be executed as uniformly as possible between the laser driver ICs during driving control other than driving control for causing the light-emitting portions to emit light based on image data.

SUMMARY OF THE INVENTION

The present invention has been made in view of the foregoing problems. The present invention provides a technique for, when a time interval between detection signals (BD signals) corresponding to light beams emitted from two light-emitting portions is to be measured in an image forming apparatus including multiple light-emitting portions, reducing measurement error by reducing variation in the light power of the light beams.

According to one aspect of the present invention, there is provided an image forming apparatus comprising: a light source including a plurality of light-emitting portions that are each configured to emit a light beam for exposing a photosensitive member; a deflection unit configured to deflect a plurality of light beams emitted from the plurality of light-emitting portions, such that the plurality of light beams scan the photosensitive member; a beam detection unit provided at a position on which a light beam deflected by the deflection unit is incident, configured to generate a detection signal indicating that the light beam has been detected according to the light beam deflected by the deflection unit being incident; a plurality of driver ICs, each configured to supply a driving current to one or more light-emitting portions of the plurality of light-emitting portions, the plurality of driver ICs each being configured to drive a different light-emitting portion; a measurement unit configured to control first and second driver ICs that respectively drive first and second light-emitting portions among the plurality of light-emitting portions, such that the first and second light-emitting portions emit first and second light beams in sequence, and to measure a time interval between two detection signals generated by the beam detection unit, which correspond to the first and second light beams; and a control unit configured to, based on the time interval measured by the measurement unit, control relative emission timings according to which the plurality of light-emitting portions emit light beams based on image data.

According to the present invention, when a time interval between detection signals (BD signals) corresponding to light beams emitted from two light-emitting portions is to be measured in an image forming apparatus including multiple light-emitting portions, measurement error can be reduced by reducing variation in the light power of the light beams.

Further features of the present invention will become apparent from the following description of exemplary embodiments with reference to the attached drawings.

DESCRIPTION OF THE EMBODIMENTS

Hereinafter, embodiments of the present invention will be described in detail with reference to the accompanying drawings. It should be noted that the following embodiments are not intended to limit the scope of the appended claims, and that not all the combinations of features described in the embodiments are necessarily essential to the solving means of the present invention.

First Embodiment

Image Forming Apparatus

Figure 1:
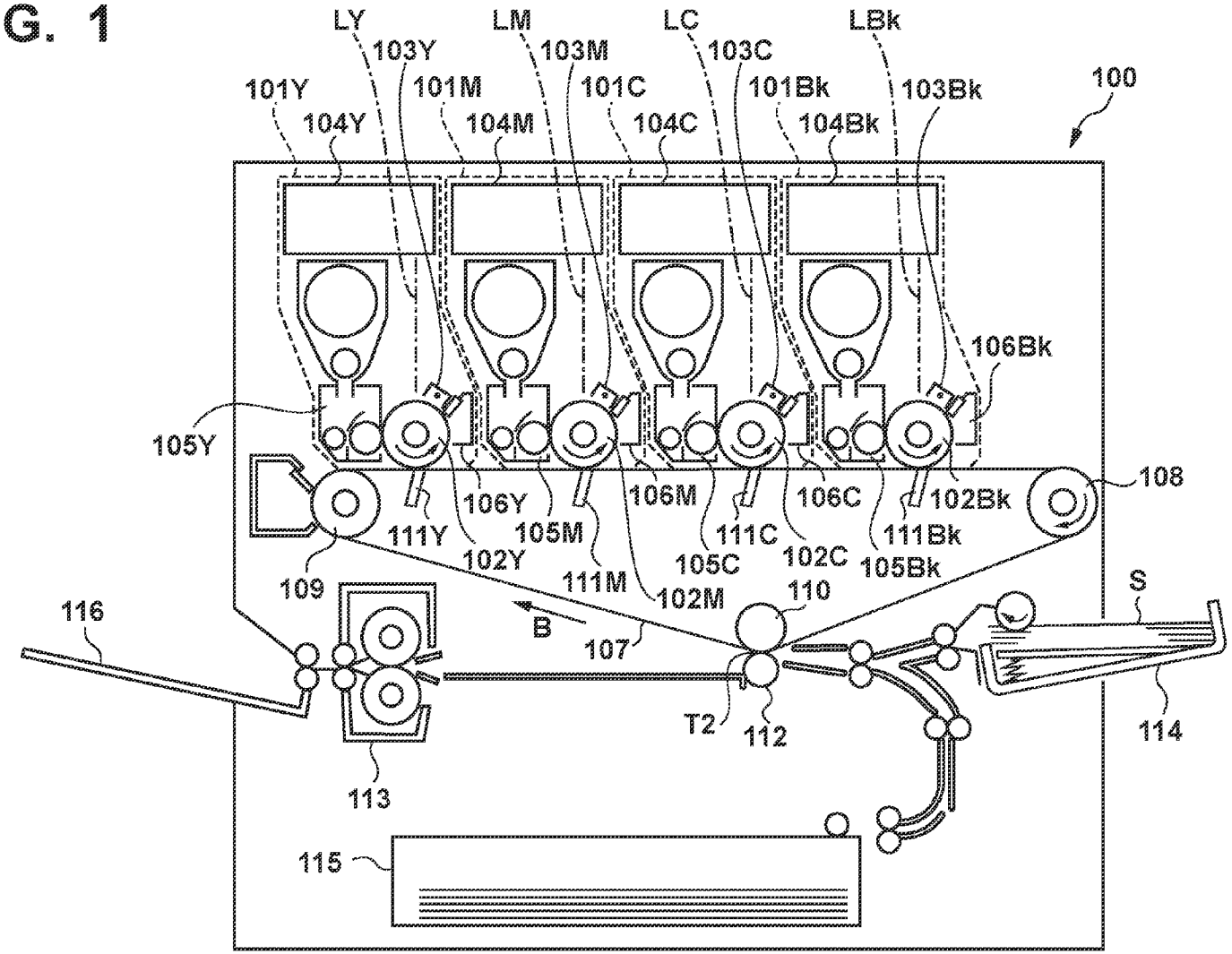
FIG. 1 is an overall cross-sectional view of an image forming apparatus.

First through fourth embodiments will be described hereinafter taking, as an example, an electrophotographic color image forming apparatus. FIG. 1 is an overall cross-sectional view of a color image forming apparatus. An image forming apparatus 100 shown in FIG. 1 is a full-color printer that forms images using multiple colors of toner. Note that in the description below, a full-color printer will be described as an example of an image forming apparatus, but another image forming apparatus, for example, a monochrome printer that forms images with one color of toner (e.g., black), or a color or monochrome copying apparatus including a image reading device may be used.

In FIG. 1, the image forming apparatus 100 has image forming units 101Y, 101M, 101C, and 101Bk, which each form an image in a corresponding color. The image forming units 101Y, 101M, 101C, and 101Bk form images using yellow (Y), magenta (M), cyan (C), and black (Bk) toner respectively.

The image forming units 101Y, 101M, 101C, and 101Bk include photosensitive drums 102Y, 102M, 102C, and 102Bk respectively, which are photosensitive members. Charging devices 103Y, 103M, 103C, and 103Bk, optical scanning apparatuses 104Y, 104M, 104C, and 104Bk, and developing devices 105Y, 105M, 105C, and 105Bk are arranged in the peripheries of the photosensitive drums 102Y, 102M, 102C, and 102Bk respectively.

Furthermore, drum cleaning devices 106Y, 106M, 106C, and 106Bk are arranged in the peripheries of the photosensitive drums 102Y, 102M, 102C, and 102Bk respectively.

An endless intermediate transfer belt 107 (intermediate transfer member) is arranged below the photosensitive drums 102Y, 102M, 102C, and 102Bk. The intermediate transfer belt 107 is tensioned by a driving roller 108 and driven rollers 109 and 110, and is driven so as to rotate in the direction of arrow B shown in FIG. 1 when image formation is in progress. Also, primary transfer devices 111Y, 111M, 111C, and 111Bk are arranged at positions opposing the photosensitive drums 102Y, 102M, 102C, and 102Bk respectively, via the intermediate transfer belt 107.

Also, the image forming apparatus 100 includes a secondary transfer device 112 for transferring a toner image on the intermediate transfer belt 107 to a recording medium S, and includes a fixing device 113 for fixing the toner image on the recording medium S.

Next, an image forming process performed by the image forming apparatus 100 will be described. Note that the image forming processes performed by the image forming units 101Y, 101M, 101C, and 101Bk are the same. For this reason, hereinafter, a description will be given taking the image forming process of the image forming unit 101Y as an example, and the description will not be repeated for the image forming processes of the image forming units 101M, 101C, and 101Bk.

First, the surface of the photosensitive drum 102Y that is driven so as to rotate in the rotation direction indicated by the arrow in FIG. 1 is uniformly charged by the charging device 103Y. Then, the charged photosensitive drum 102Y is exposed using a laser beam LY (light beam) emitted from the optical scanning apparatus 104Y. This forms an electrostatic latent image on the photosensitive drum 102Y. Thereafter, the electrostatic latent image is developed by the developing device 105Y, and a yellow toner image is formed on the photosensitive drum 102Y.

The primary transfer devices 111Y, 111M, 111C, and 111Bk apply a transfer bias to the intermediate transfer belt 107. Accordingly, the yellow, magenta, cyan, and black toner images on the photosensitive drums 102Y, 102M, 102C, and 102Bk are transferred onto the intermediate transfer belt 107. As a result, a multi-color toner image (color toner image) is formed on the intermediate transfer belt 107.

The color toner image on the intermediate transfer belt 107 is transferred by the secondary transfer device 112 onto a recording medium S that has been conveyed from a manual feed cassette 114 or a paper feeding cassette 115 to a second transfer portion T2. Then, the color toner image on the recording medium S undergoes thermal fixing by a fixing device 113, and thereafter, the recording medium S is discharged to a discharge portion 116.

Note that remaining toner that is not transferred onto the intermediate belt 107 and remains on the photosensitive drums 102Y, 102M, 102C, and 102Bk is removed by the drum cleaning devices 106Y, 106M, 106C, and 106Bk respectively. Thereafter, the above-described image forming process is executed again.

Optical Scanning Apparatus

Figure 2:
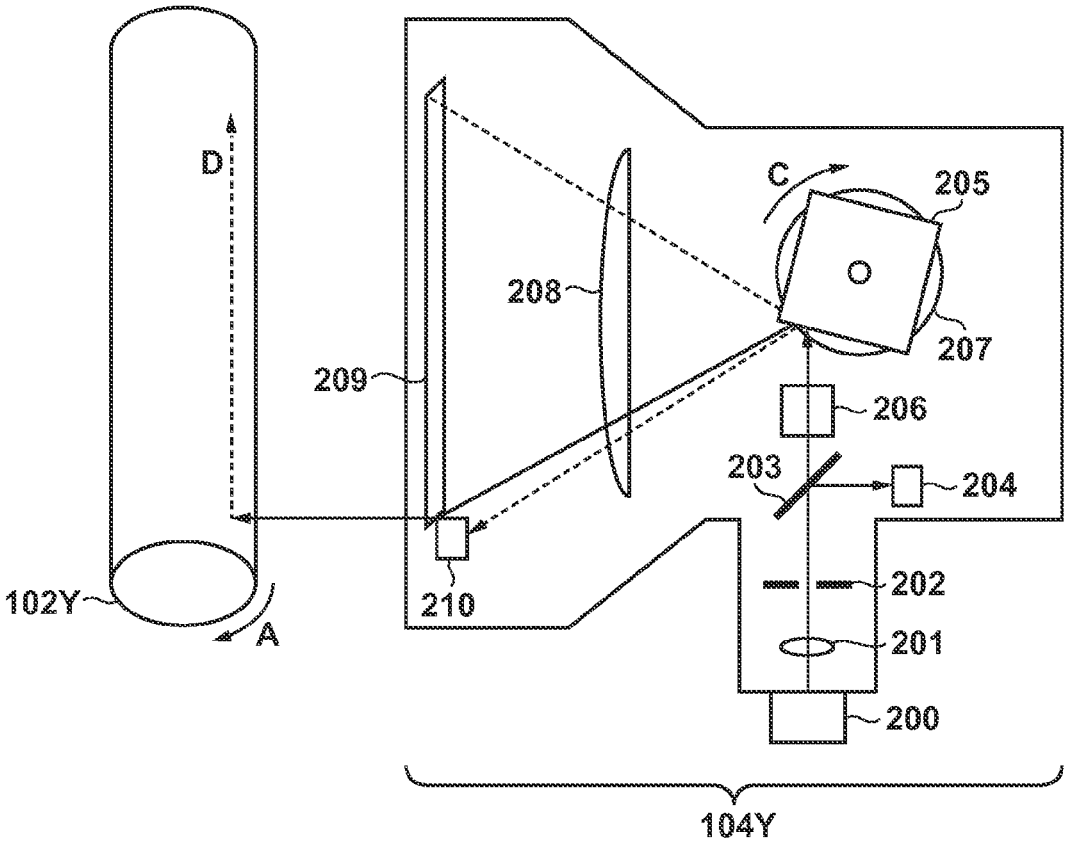
FIG. 2 is a diagram showing an overall configuration of an optical scanning apparatus.

FIG. 2 is a diagram showing an overall configuration of optical scanning apparatuses 104Y, 104M, 104C, and 104Bk. The optical scanning apparatuses each have the same configuration, and therefore the optical scanning apparatus 104Y is shown as an example in FIG. 2 (and in later-described FIGS. 3A to 3C). In FIG. 2, laser beams, which are diverging light emitted from a semiconductor laser 200, are made roughly parallel by a collimator lens 201, and an aperture 202 restricts the passage of the laser beams. This shapes the laser beams. After passing through the aperture 202, the laser beams are incident on a beam splitter 203. The beam splitter 203 divides the laser beams that have passed through the aperture 202 into laser beams that are to be incident on a photo diode (PD) 204, and laser beams that are to be incident on a rotating polygonal mirror 205 (referred to below as "polygon mirror 205"), which is an example of a deflection unit. Upon receiving a laser beam, the PD 204 outputs a detection signal with a value (voltage) corresponding to the light power of the received laser beam.

After passing through the beam splitter 203, the laser beams pass through a cylindrical lens 206 and are incident on the polygon mirror 205. The polygon mirror 205 includes multiple reflecting surfaces (4 surfaces in the present embodiment). The polygon mirror 205 rotates in the direction of arrow C by being driven by a motor 207. The polygon mirror 205 deflects the laser beams such that the laser beams scan the photosensitive drum 102Y in the direction of arrow D. The laser beams deflected by the polygon mirror 205 pass through an image forming optical system (fθ lens) 208 having an fθ property and are guided to the photosensitive drum 102Y (photosensitive member) via a mirror 209. In this way, the polygon mirror 205 deflects multiple laser beams emitted from the semiconductor laser 200 (multiple light-emitting portions 301 to 308 shown in FIG. 3A) such that the laser beams scan the photosensitive drum 102Y.

The optical scanning apparatus 104Y includes a beam detection (BD) sensor 210. The BD sensor 210 is arranged at a position on the scanning path of laser beams, on which the laser beams deflected by the polygon mirror 205 are incident, outside of the image forming region on the photosensitive drum 102Y. In response to a laser beam deflected by the polygon mirror 205 being received, the BD sensor 210 generates and outputs, as a synchronization signal (horizontal synchronization signal), a detection signal (BD signal) indicating that a laser beam has been detected.

Laser Light Source

Figure 3A:
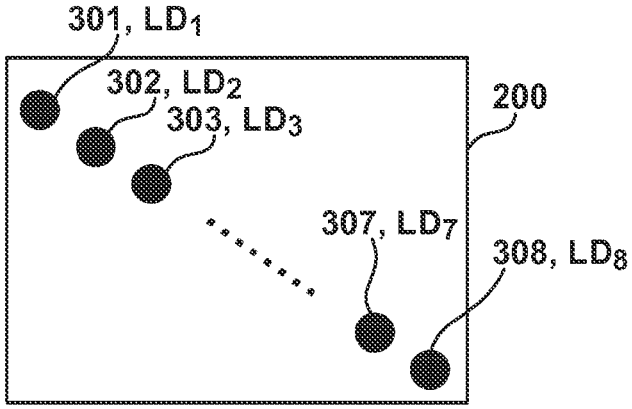
FIGS. 3A to 3C are diagrams showing an alignment of light-emitting portions of a semiconductor laser and exposure positions on a photosensitive drum.
Figure 3B:
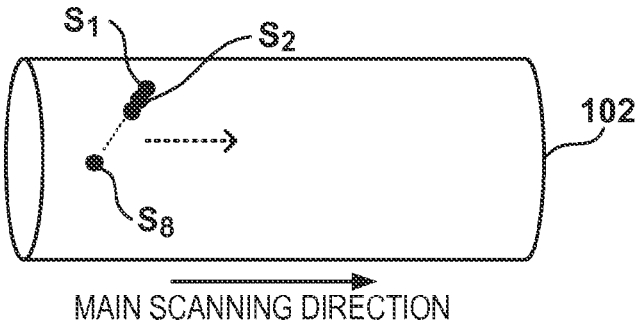

Next, a light source (laser light source) included in the optical scanning apparatuses 104Y, 104M, 104C, and 104Bk will be described. FIG. 3A shows multiple light-emitting portions included in the semiconductor laser 200 shown in FIG. 2, and FIG. 3B is a diagram showing an image of an alignment of laser spots on the photosensitive drum 102Y in the case where laser beams are emitted at the same time from the multiple light-emitting portions.

As shown in FIG. 3A, the semiconductor laser 200 is a vertical cavity surface emitting laser (VCSEL) that includes multiple (in the present embodiment, 8) light-emitting portions 301 to 308. Note that not only is it possible to use a VCSEL, but it is also possible to use an edge emitting semiconductor laser as the semiconductor laser. The present embodiment can be applied not only to the case where the semiconductor laser 200 includes 8 light-emitting portions, but also to the case where the semiconductor laser 200 includes any number of light-emitting portions that is greater than or equal to 2 (e.g., 32) similarly.

The light-emitting portions 301 to 308 are arranged in an array on a substrate. Since the light-emitting portions are aligned as shown in FIG. 3A, if the light-emitting portions are turned on at the same time, the laser beams $L_1$ to $L_8$ emitted from light-emitting portions expose different positions on the photosensitive drum 102Y in the main scanning direction, as with image forming positions $S_1$ to $S_8$ shown in FIG. 3B. Also, if the light-emitting portions are turned on at the same time, the laser beams $L_1$ to $L_8$ emitted from the light-emitting portions expose different positions in the sub-scanning direction, as with the image forming positions $S_1$ to $S_8$ shown in FIG. 3B. Note that FIG. 3A shows an example in which the light-emitting portions are arranged in one line (one-dimensional arrangement), but the arrangement of the light-emitting portions may be a two-dimensional arrangement.

Figure 3C:
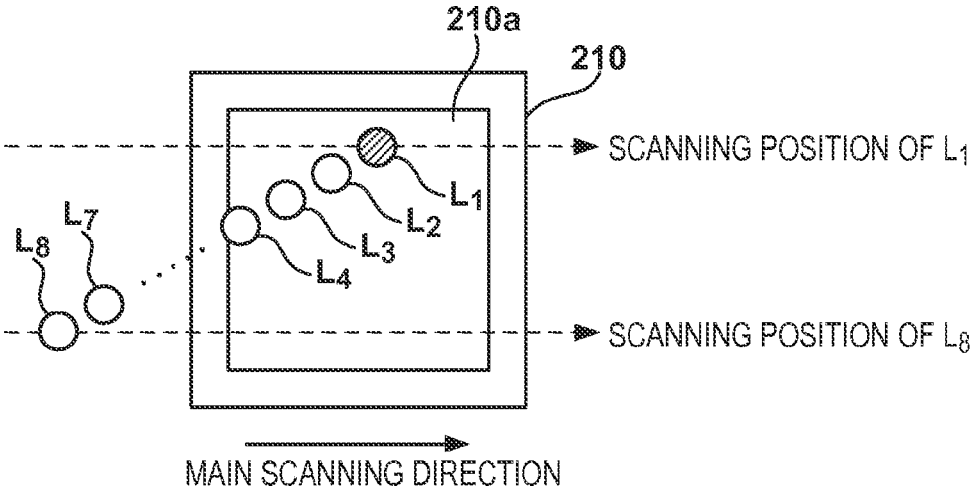

FIG. 3C is a diagram showing an overall configuration of the BD sensor 210 arranged at a position on the scanning path of the laser beams, and the positions on the BD sensor 210 that are scanned by the laser beams $L_1$ to $L_8$ emitted from the light-emitting portions 301 to 308 ($LD_1$ to $LD_8$) of the semiconductor laser 200. The BD sensor 210 includes a light-receiving surface 210*a* in which photoelectric conversion elements are arranged planarly. When a laser beam is incident on the light-receiving surface 210*a*, the BD sensor 210 generates and outputs a detection signal (BD signal) that indicates that a laser beam has been detected. As an example, FIG. 3C shows a state in which only the light-emitting portion 301 ($LD_1$) of the light-emitting portions 301 to 308 is turned on, and the laser beam $L_1$ emitted from that light-emitting portion is incident on the light-receiving surface 210*a*. Note that in the BD interval measurement of the present embodiment, the laser beams $L_1$ and $L_8$ emitted from the light-emitting portions 301 and 308 ($LD_1$ and $LD_8$) are caused to be incident on the BD sensor 210 in sequence, and thereby two BD signals corresponding to these laser beams are caused to be output from the BD sensor 210 in sequence.

Control System for Image Forming Apparatus

Figure 4:
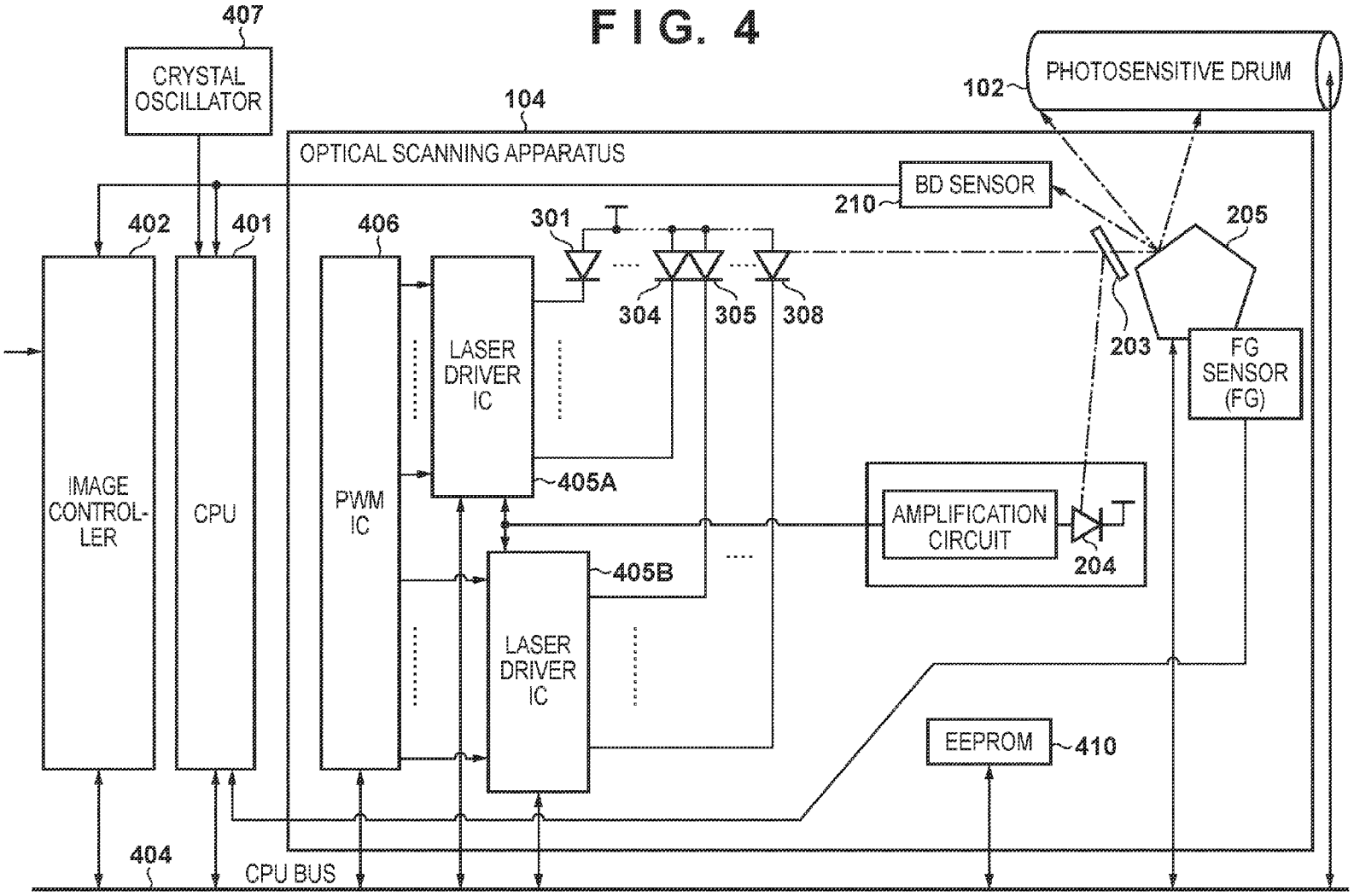
FIG. 4 is a diagram showing control blocks of an image forming apparatus.

FIG. 4 is a diagram of control blocks for describing an example of a control system used by the image forming apparatus 100 shown in FIG. 1. Note that the configurations of the optical scanning apparatuses 104Y, 104M, 104C, and 104Bk are the same, and therefore the suffixes Y, M, C, and Bk will be omitted in the description below. Note that the configuration regarding the eight beams is a parallel repeating configuration, and therefore a portion thereof is omitted in FIG. 4.

The image forming apparatus 100 includes a CPU 401, an image controller 402, the optical scanning apparatus 104, the photosensitive drum 102, a crystal oscillator 407, a CPU bus 404, and an EEPROM 410 arranged in the optical scanning apparatus 104. The CPU 401 and the image controller 402 are included in the main body of the image forming apparatus, and both are connected to the optical scanning apparatus 104. The optical scanning apparatus 104 has a PWMIC 406, and first and second laser drivers (laser driver ICs) 405A and 405B. Note that in order to simplify the description, the first and second laser drivers 405A and 405B and the light-emitting portions 301 to 308 (light emitting elements) corresponding to only one color among Y, M, C, and Bk are shown in FIG. 4. In actuality, first and second laser drivers 405A and 405B and light-emitting portions 301 to 308 are provided for each color among Y, M, C, and Bk.

The CPU 401 performs overall control of the image forming apparatus including the optical scanning apparatuses 104. The CPU 401 receives supply of a 100-MHz reference clock from the crystal oscillator 407. The CPU 401 multiplies the reference clock by 10 using a built-in PLL circuit, thereby generating a 1-GHz clock, which is an image clock for the laser scanning system. Note that the CPU 401 may be included in the optical scanning apparatus 104. In such a case, the CPU 401 controls operations performed by the optical scanning apparatus 104, according to instructions from a CPU (not shown) that is included in the main body of the image forming apparatus and performs overall control of the image forming apparatus.

The image controller 402 divides image data received from an external apparatus connected to the image forming apparatus 100 or from the reading apparatus attached to the image forming apparatus into the four color components Y, M, C, and Bk. The image controller 402 outputs the image data for the four color components Y, M, C, and Bk to the CPU 401 via the CPU bus 404, in synchronization with the reference clock.

The CPU 401 stores the image data received from the image controller 402 in a memory (not shown) and converts the image data stored in the memory into a differential signal (low differential voltage signal (LDVS)) based on the image clock. The CPU 401 outputs the differential signal to the PWMIC 406 via the CPU bus 404 at a timing based on the BD signal and the image clock signal.

Based on the differential signal input from the CPU 401, the PWMIC 406 generates PWM signals to be used in PWM modulation of the laser beams emitted from the light-emitting portions 301 to 308 and supplies them to the laser drivers 405A and 405B. Note that PWM signals corresponding to light-emitting portions being driven by a laser driver are supplied by the PWMIC 406 to that laser driver. That is to say, the PWMIC 406 supplies the PWM signals corresponding to the light-emitting portions being driven by the laser driver 405A to the laser driver 405A, and supplies the PWM signals corresponding to the light-emitting portions being driven by the laser driver 405B to the laser driver 405B.

The optical scanning apparatus 104 of the present embodiment includes the laser drivers 405A and 405B as examples of a plurality of driver ICs. The laser drivers 405A and 405B each supply a driving current to one or more light-emitting portions among the light-emitting portions 301 to 308. The laser drivers 405A and 405B each drive different light-emitting portions. Specifically, as shown in FIG. 4, the laser driver 405A drives the light-emitting portions 301 to 304, and the laser driver 405B drives the light-emitting portions 305 to 308.

The laser drivers 405A and 405B of the present embodiment are laser driver ICs constituted by integrated circuits (ICs) with the same part model number, and control the light-emitting portions 301 to 304 and the light-emitting portions 305 to 308 respectively. A direct-current 5-V line and a ground line are supplied from the main body rear surface substrate (not shown) to the laser drivers 405A and 405B, and power is supplied from a shared power source to the laser drivers 405A and 405B and the light-emitting portions 301 to 308.

To the light-emitting portions being driven, the laser drivers 405A and 405B supply driving currents based on the PWM signal supplied from the PWMIC 406, thereby causing laser beams for forming an electrostatic latent image to be emitted from the light-emitting portions. Also, in accordance with instructions from the CPU 401, the laser drivers 405A and 405B execute automatic power control (APC) with respect to the light-emitting portions being driven (being controlled). Information regarding the APC sequence that is to be executed in the optical scanning apparatus 104 is stored in the EEPROM 410. The CPU 401 controls the laser drivers 405A and 405B such that the APC for the light-emitting portions is executed in an order which is based on the information regarding the APC sequence stored in the EEPROM 410.

In the case of executing APC for one of the light-emitting portions being driven, the laser drivers 405A and 405B control the value of the driving current supplied to that light-emitting portion according to the light power of the laser beam detected by the PD 204. Accordingly, the laser drivers 405A and 405B control the light power of the laser beam emitted from the light-emitting portion so as to be a target light power. Note that the PD 204 is an example of a light power detection unit configured to detect light power of a laser beam emitted from each of the light-emitting portions 301 to 308. As will be described later, in each laser beam scanning cycle, the CPU 401 executes APC on each light-emitting portion in sequence while sequentially switching the light-emitting portions on which APC is executed, according to the number of light-emitting portions on which APC can be executed in one scanning cycle.

BD Interval Measurement

With the image forming apparatus 100, due to the configuration of the light source (semiconductor laser 200) such as that shown in FIG. 3A, the laser beams emitted from the light-emitting portions form images at the different positions $S_1$ to $S_8$ in the main scanning direction on the photosensitive drum 102, as shown in FIG. 3B. In this case, in order to align the writing start positions in the main scanning direction for the electrostatic latent image (image) that is to be formed by the laser beams emitted from the light-emitting portions, the timing at which each of the laser beams is emitted needs to be controlled appropriately for each light-emitting portion.

In the present embodiment, the CPU 401 controls the laser drivers 405A and 405B such that two light-emitting portions (first and second light-emitting portions) among N (in the present embodiment, N=8) light-emitting portions emit two laser beams (first and second light beams) in sequence. Furthermore, the CPU 401 measures the time interval (in the present specification, also referred to as the "BD interval") between two BD signals (first and second detection signals) that correspond to two laser beams and are generated by the BD sensor 210 in sequence due to the two laser beams being incident on the BD sensor 210 in sequence (BD interval measurement). The CPU 401 performs the BD interval measurement in a non-image-forming period in which image formation on a recording medium is not performed. Furthermore, in an image forming period in which image formation is performed, the CPU 401 uses a single BD signal generated in each laser beam scanning cycle as a reference to control, based on the measurement value obtained using BD interval measurement, the relative emission timings at which the light-emitting portions emit the laser beams based on image data.

With BD interval measurement, in order to reduce measurement error, the light power when the laser beams (first and second light beams) from the first and second light-emitting portions used in measurement are received by the BD sensor 210 needs to be made constant, as described above. The light power of the laser beams incident on the BD sensor 210 can be controlled so as to be a constant light power (target light power) by executing APC on the first and second light-emitting portions used in measurement. However, as described above, variation can occur in the magnitudes of the driving currents supplied to the first and second light-emitting portions due to the temperature of the laser driver ICs (laser drivers 405A and 405B) at the time of driving the first and second light-emitting portions. If there is variation in the magnitudes of the driving currents supplied to the first and second light-emitting portions at the time of BD interval measurement, the accuracy of BD interval measurement can decrease.

Summary of Present Embodiment

Figure 5:
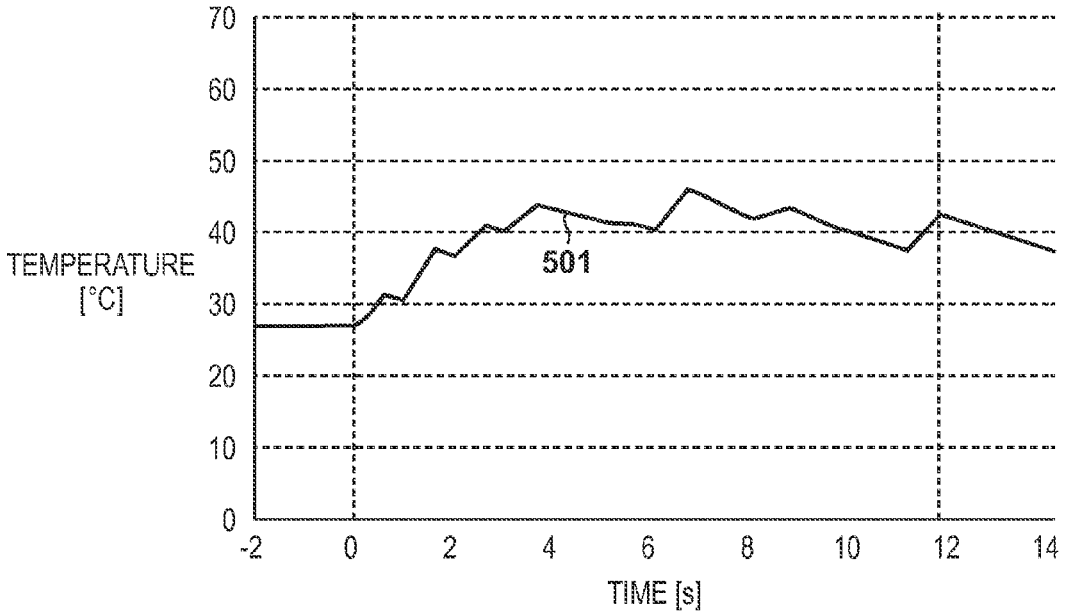
FIG. 5 is a diagram showing an example of temperature change in a laser driver IC when executing image formation in an image forming apparatus.

Here, FIG. 5 is a diagram showing an example of temperature change in a laser driver IC (laser driver 405A) when executing image formation in the image forming apparatus 100, and an example is shown in which image formation was executed continuously on 12 A4 sheets for about 24 seconds. As shown in FIG. 5, the laser driver 405A, which was 27° C. before image formation started, rises to around 40° C. upon image formation being started. Thereafter, the laser driver 405A repeatedly generates heat during image formation on a sheet (about 1 second) and dissipates heat during non-image-formation between sheets (about 1 second), whereby the temperature repeatedly rises and falls. When image formation ends, the laser driver 405A dissipates heat over time, and the temperature gradually falls.

Figure 6:
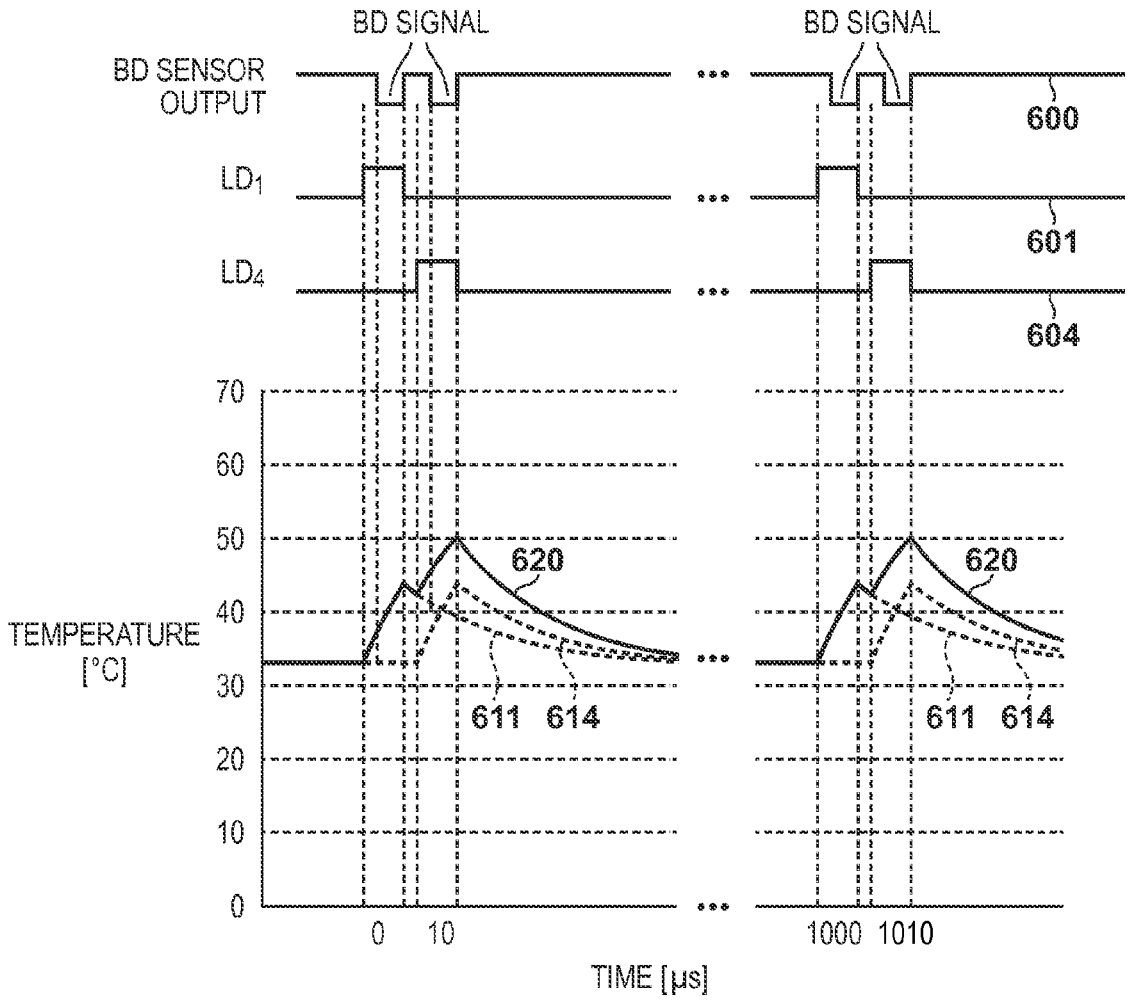
FIG. 6 is a diagram showing an example of temperature change in a laser driver IC when executing BD interval measurement.

Next, FIG. 6 is a diagram showing temperature change in a laser driver IC in the case of executing BD interval measurement using the laser driver IC (laser driver 405A) which has the aforementioned temperature property. FIG. 6 shows an output signal 600 of the BD sensor 210, light powers 601 and 604 of the light-emitting portions 301 and 304 ($LD_1$ and $LD_4$), and a local temperature 620 of the drive circuits in the laser driver 405A that correspond to the light-emitting portions 301 to 304 being driven.

FIG. 6 shows an example in which $LD_1$ and $LD_4$ are used as the first and second light-emitting portions in the BD interval measurement. First, in order to cause the BD sensor 210 to generate the first BD signal, the laser driver 405A turns on $LD_1$ for 5 μs. For 2 μs after turning off $LD_1$, the laser driver 405A turns on $LD_4$ for 5 μs in order to cause the BD sensor 210 to generate the second BD signal. Accordingly, as shown in FIG. 6, the first and second BD signals are generated and output by the BD sensor 210. The CPU 401 measures the time interval between the first and second BD signals using the falling edges of the BD signals, for example, as references, and the measurement result is around 7 μs.

The temperature 620 of the driving circuit in the laser driver 405A while BD interval measurement is being executed rises and falls in accordance with the light emission of $LD_1$ and $LD_4$. In particular, the temperature 620 is around 14° C. higher at the time of generating the second BD signal (falling edge time) than at the time of generating the first BD signal (falling edge time). This is dependent on a temperature component 611 that corresponds to heat generation and heat dissipation accompanying light emission of $LD_1$, and a temperature component 612 that corresponds to heat generation and heat dissipation accompanying the emission of light by $LD_4$. That is to say, the temperature 620 of the driving circuit is higher at the time of generating the second BD signal than at the time of generating the first BD signal since the light emission of $LD_4$ is started after $LD_1$ is turned off and before the temperature of the driving circuit sufficiently lowers. Note that the change in the temperature components 611 and 612 is dependent on a relatively short (several μs) time constant for the internal heat diffusion via the ground of the IC or a power source electrode layer, a relatively long (several tens of ms) time constant for the external thermal diffusion via the terminals of the IC, and a temperature property of the parasitic resistance in the IC.

Due to the change in the temperature 620 shown in FIG. 6, the driving current supplied to the second light-emitting portion is less than the driving current supplied to the first light-emitting portion in the BD interval measurement. Accordingly, the measured value for the BD interval changes to a value that is larger than that in the case where driving currents with the same magnitude are supplied to the first and second light-emitting portions, and as described above, the accuracy of BD interval measurement decreases. However, in order to prevent the accuracy of BD interval measurement from decreasing, the driving currents supplied to the first and second light-emitting portions used in BD interval measurement need to be made as constant as possible.

In view of this, the image forming apparatus 100 of the present embodiment uses, as the first and second light-emitting portions used in BD interval measurement, two light-emitting portions which are driven by different laser driver ICs. That is to say, the CPU 401 of the image forming apparatus 100 controls the laser driver ICs which respectively drive the first and second light-emitting portions such that the first and second light-emitting portions being driven by different laser driver ICs emit the first and second laser beams in sequence. Furthermore, the CPU 401 measures the time interval between the two BD signals that correspond to the first and second laser beams and are generated by the BD sensor 210 due to the first and second laser beams being incident thereon. Specifically, the image forming apparatus 100 uses, as the first light-emitting portion, the light-emitting portion 301 ($LD_1$) driven by the laser driver 405A, and uses, as the second light-emitting portion, the light-emitting portion 308 ($LD_8$) driven by the laser driver 405B.

By doing so, the CPU 401 controls the laser drivers 405A and 405B such that the temperatures of the driving circuits in the laser drivers 405A and 405B that correspond to the light-emitting portions 301 and 308 change similarly between the laser drivers. Accordingly, the driving currents supplied to the first and second light-emitting portions at the time of BD interval measurement can be given the same magnitude, and a decrease in the accuracy of BD interval measurement can be suppressed.

Example of Executing BD Interval Measurement

Figure 7:
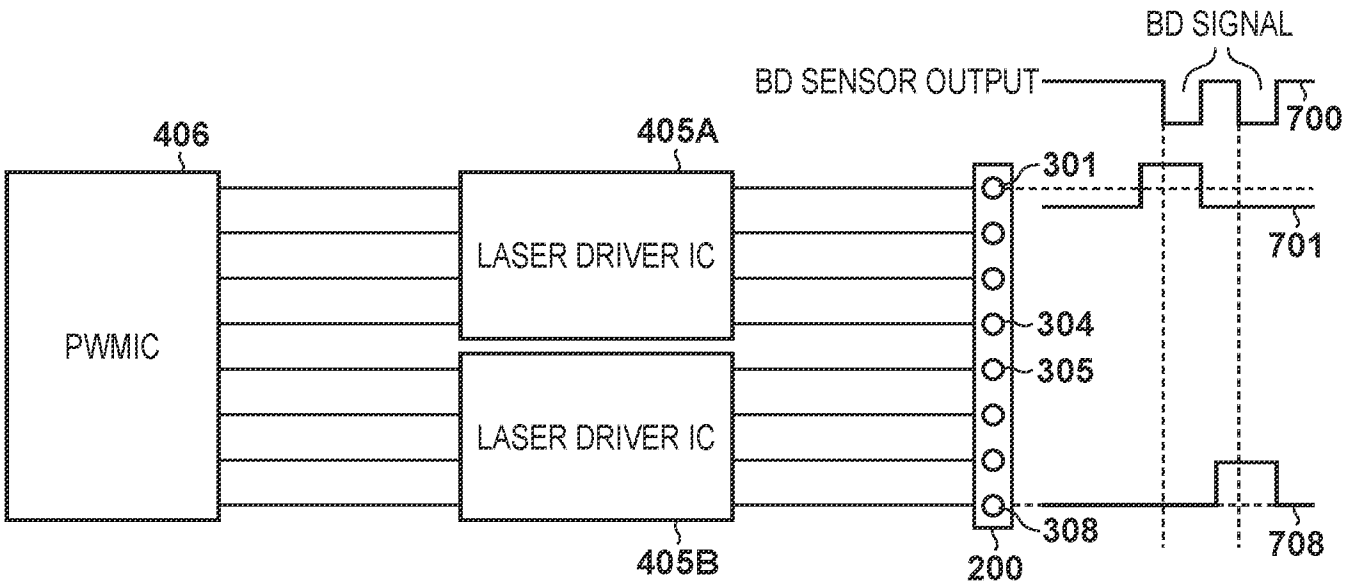
FIG. 7 is a diagram showing an example of a configuration of an optical scanning apparatus relating to BD interval measurement, according to a first embodiment.

Next, FIG. 7 is a diagram showing an example of a configuration of the optical scanning apparatus 104 related to BD interval measurement according to the first embodiment. In the present embodiment, the laser driver 405A is connected to the light-emitting portions 301 to 304 of the semiconductor laser 200 and drives those light-emitting portions. Also, the laser driver 405B is connected to the light-emitting portions 305 to 308 of the semiconductor laser 200 and drives those light-emitting portions. The light-emitting portions 301 and 308 ($LD_1$ and $LD_8$), which are driven by different laser driver ICs (laser drivers 405A and 405B), are used as the first and second light-emitting portions in BD interval measurement. Note that as shown in FIG. 7, $LD_1$ and $LD_8$ are light-emitting portions arranged at one end and another end of the light-emitting portions 301 to 308, which are arranged linearly in one line in the semiconductor laser 200.

Specifically, as shown in FIG. 7 (light powers 701 and 708 of $LD_1$ and $LD_8$), the CPU 401 controls the laser drivers 405A and 405B such that $LD_1$ and $LD_8$ emit the laser beams in sequence. For example, the laser drivers 405A and 405B supply driving currents of the same magnitude, which is set using APC executed beforehand, to $LD_1$ and $LD_8$ at different times. Accordingly, the laser beams emitted from $LD_1$ and $LD_8$ are incident on the BD sensor 210 in sequence, and two BD signals (first and second BD signals) are generated as output signals 700 of the BD sensor 210.

Figure 8:
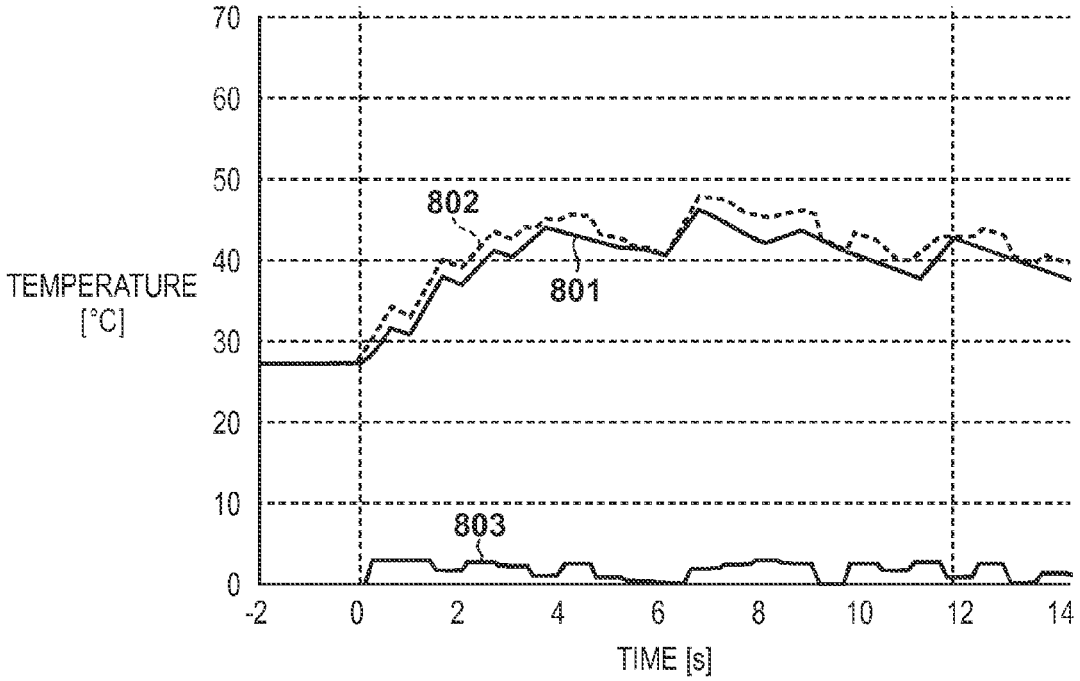
FIG. 8 is a diagram showing an example of temperature change in laser driver ICs when executing image formation in an image forming apparatus, according to the first embodiment.

Here, FIG. 8 is a diagram showing an example of temperature change in the laser drivers 405A and 405B when executing image formation in the image forming apparatus 100, and shows an example in which image formation is continuously executed on 12 A4 sheets for 24 seconds. Note that FIG. 8 shows overall average temperatures 801 and 802 of the laser drivers 405A and 405B, and a temperature difference 803 between the average temperatures 801 and 802. Upon starting image formation, the temperatures of the laser drivers 405A and 405B, which were 27° C. before image formation started, rise to around 40° C. Thereafter, the laser drivers 405A and 405B repeatedly generate heat during image formation on a sheet (about 1 second) and dissipate heat during non-image-formation between sheets (about 1 second), whereby each temperature repeatedly rises and falls. When image formation ends, the laser drivers 405A and 405B dissipate heat over time, and the temperature of each laser driver gradually falls.

As shown in FIG. 8, the temperature difference 803 between the overall average temperatures 801 and 802 of the laser drivers 405A and 405B is around 2.5° C. or less overall, and temperature changes that are almost the same are shown. For this reason, it can be said that the temperature difference between the laser drivers 405A and 405B has a relatively small influence on the accuracy of BD interval measurement in the case of executing BD interval measurement between sheets while image formation is executed continuously on multiple sheets.

Figure 9:
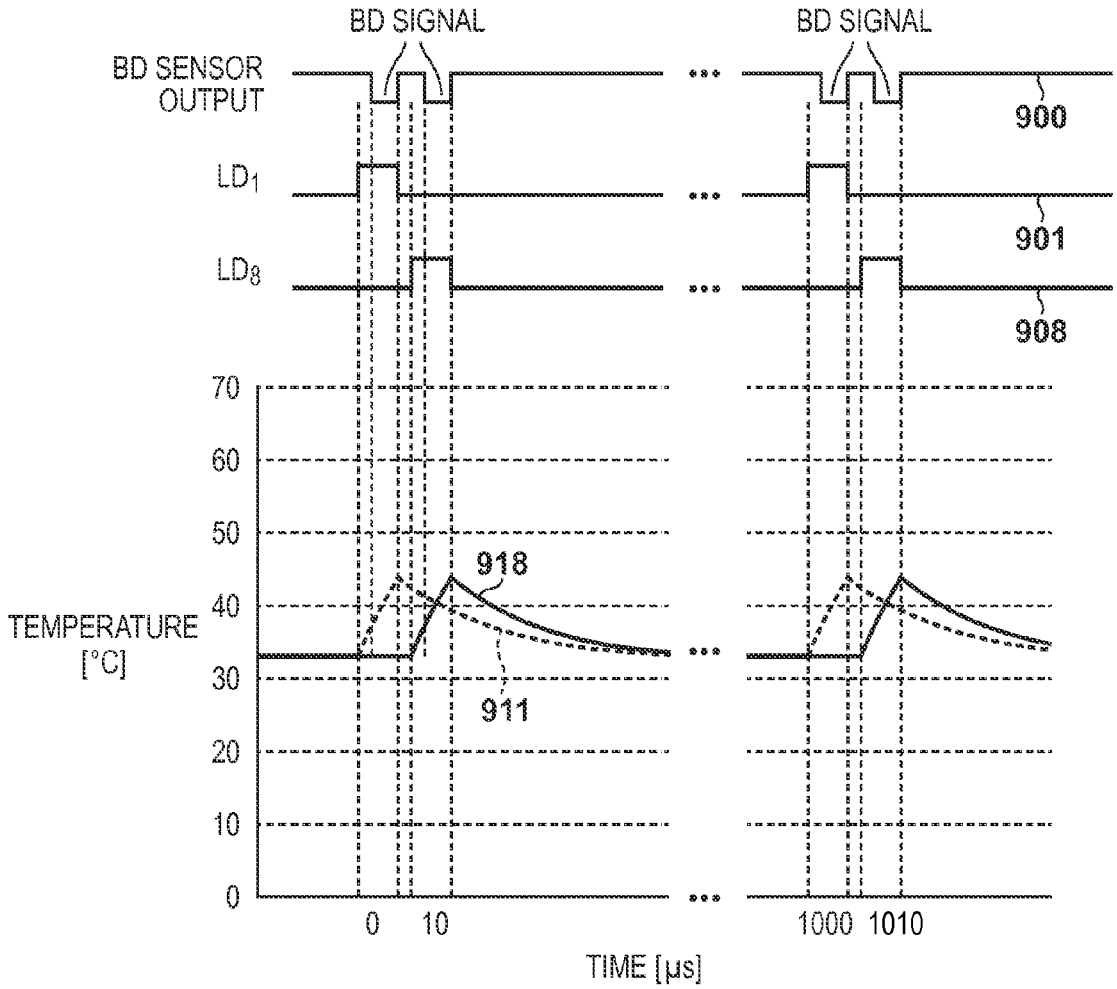
FIG. 9 is a diagram showing an example of temperature change in laser driver ICs when executing BD interval measurement, according to the first embodiment.

Next, FIG. 9 is a diagram showing an example of temperature changes in the laser drivers 405A and 405B in the case of executing BD interval measurement. FIG. 9 shows an output signal 900 of the BD sensor 210, light powers 901 and 908 of the light-emitting portions 301 and 308 ($LD_1$ and $LD_8$), and local temperatures 911 and 918 of the drive circuits in the laser drivers 405A and 405B, which correspond to the light-emitting portions 301 and 308.

As shown in FIG. 9, when executing BD interval measurement, the temperatures of the driving circuits tend to change (rise and fall) by about 10° C. in a short time in accordance with the light emission of $LD_1$ and $LD_8$. However, in the present embodiment, the temperature change in the driving circuit in the laser driver 405A that accompanies the emission of light by $LD_1$ and the temperature change in the driving circuit in the laser driver 405B that accompanies the emission of light by $LD_8$ do not influence each other. That is to say, the temperature of the driving circuit in the laser driver 405A when the driving current is supplied to the first light-emitting portion ($LD_1$) and the temperature of the driving circuit in the laser driver 405A when the driving current is supplied to the second light-emitting portion ($LD_8$) are approximately equal, as shown in FIG. 9.

As described above, in the present embodiment, two light-emitting portions 301 and 308 that are driven by the laser drivers 405A and 405B, which are different laser driver ICs, are used as the first and second light-emitting portions used in BD interval measurement. Accordingly, it is possible to prevent the driving currents supplied to the first and second light-emitting portions at the time of BD interval measurement from becoming different magnitudes due to temperature changes in the driving circuits which respectively drive the light-emitting portions, and to suppress a decrease in the accuracy of BD interval measurement.

Second Embodiment

The temperature properties of the driving circuits in the laser drivers 405A and 405B, which correspond to the light-emitting portions 301 and 308 ($LD_1$ and $LD_8$) used in BD interval measurement, which have been described in the first embodiment, tend to be dependent on the arrangement of the driving circuit on the circuit board of the laser driver IC. Accordingly, in order to further increase the degree to which the temperature properties of the driving circuits corresponding to the light-emitting portions 301 and 308 match, it is advantageous to use the same configuration for each laser driver IC and to arrange the driving circuits in the circuit boards of the laser driver ICs such that they are symmetrical (equivalent).

Figure 10:
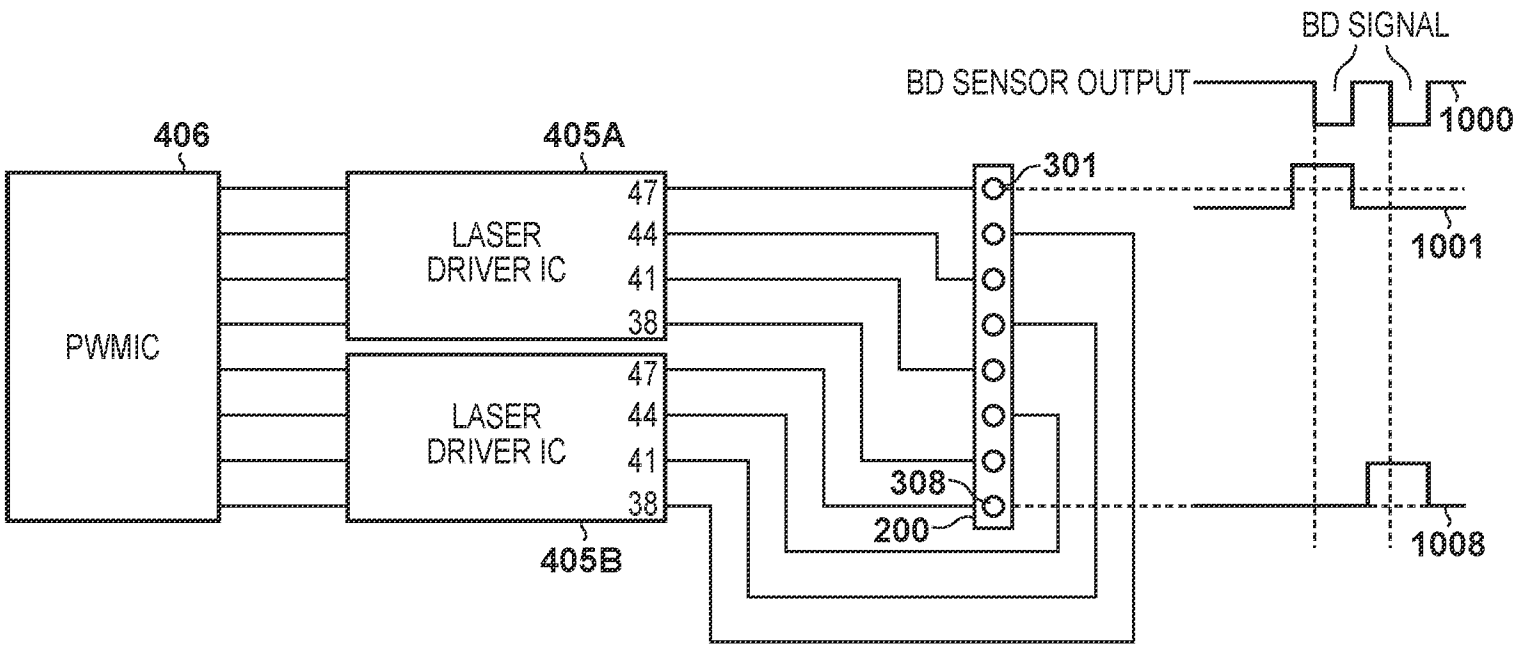
FIG. 10 is a diagram showing an example of a configuration of an optical scanning apparatus relating to BD interval measurement, according to a second embodiment.
Figure 11:
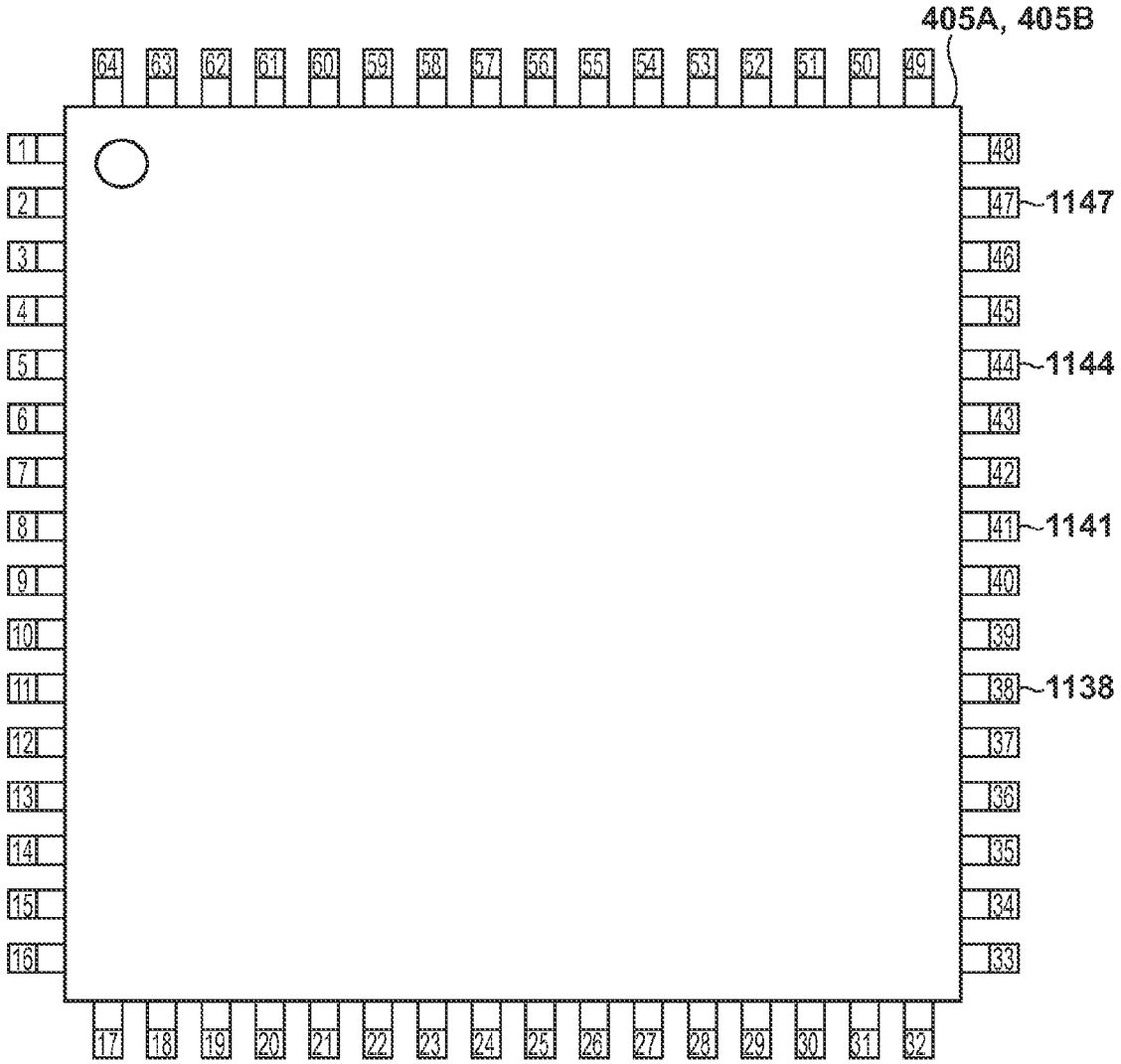
FIG. 11 is a diagram showing an example of a configuration of a laser driver IC according to the second embodiment.

FIG. 10 is a diagram showing an example of the configuration of the optical scanning apparatus 104 relating to BD interval measurement according to the second embodiment. In the present embodiment, the laser drivers 405A and 405B are ICs with the same configuration, and are each constituted by a Quad Flat Package (QFP), as shown in FIG. 11. The laser drivers 405A and 405B each include one or more driving circuits that respectively correspond to one or more driven light-emitting portions and that respectively supply driving currents to different light-emitting portions.

Specifically, terminals with numbers 47, 44, 41, and 38 (terminals 1147, 1144, 1141, and 1138) of the laser driver 405A are connected respectively to the light-emitting portions 301, 303, 305, and 307 of the semiconductor laser 200. Also, terminals with numbers 47, 44, 41, and 38 (terminals 1147, 1144, 1141, and 1138) of the laser driver 405B are connected respectively to the light-emitting portions 302, 304, 306, and 308 of the semiconductor laser 200. According to this connection relationship, the laser driver 405A drives the light-emitting portions 301, 303, 305, and 307, and the laser driver 405B drives the light-emitting portions 302, 304, 306, and 308.

In the present embodiment, the driving circuits that correspond to the light-emitting portions 301 and 308 ($LD_1$ and $LD_8$) used in BD interval measurement are arranged in the same regions on circuit boards of different ICs (laser drivers 405A and 405B). Specifically, as shown in FIGS. 10 and 11, the driving circuits that correspond to $LD_1$ and $LD_8$ are connected to $LD_1$ and $LD_8$ respectively via the same terminals 1147 of the circuit boards of the different ICs (laser drivers 405A and 405B). Accordingly, the arrangements of the driving circuits on the circuit boards of the laser driver ICs can be made symmetrical, and it is possible to further increase the degree to which the temperature properties of the driving circuits corresponding to $LD_1$ and $LD_8$ at the time of executing BD interval measurement match.

Third Embodiment

In the second embodiment, in order to further increase the degree to which the temperature properties of the driving circuits corresponding to the light-emitting portions 301 and 308 ($LD_1$ and $LD_8$) at the time of executing BD interval measurement match, the driving circuits are arranged on the circuit boards of the laser drivers 405A and 405B symmetrically. In the third embodiment, in order to further increase the degree to which the temperature properties of the driving circuits corresponding to $LD_1$ and $LD_8$ match to an extent greater than that of the second embodiment, consideration is given also to the symmetry of executing APC on the light-emitting portions being driven by the laser drivers 405A and 405B. Note that the configuration of the optical scanning apparatus 104 is the same as that of the second embodiment (FIGS. 10 and 11).

Figure 12A:
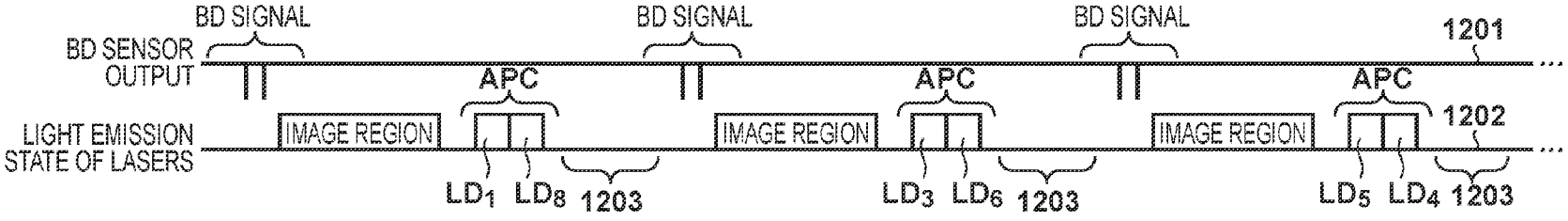
FIGS. 12A and 12B are timing charts showing the timing of operations performed by the optical scanning apparatus, according to third and fourth embodiments.

FIG. 12A is a timing chart showing the timing of operations performed by the optical scanning apparatus 104 according to the third embodiment. FIG. 12A shows an output signal 1201 of the BD sensor 210 and a light emission state 1202 of the semiconductor laser 200. One scanning cycle of the laser beams emitted from the light-emitting portions ($LD_1$ to $LD_8$) of the semiconductor laser 200 includes an image formation period in which the image region of the photosensitive drum 102 is scanned and a non-image-forming period in which a region other than the image region is scanned. As shown in FIG. 12A, in each laser beam scanning cycle, the CPU 401 uses the non-image-forming period to execute APC on the light-emitting portions.

Specifically, in each laser beam scanning cycle, the CPU 401 causes each of the multiple laser driver ICs (laser drivers 405A and 405B) to execute APC on the same number of light-emitting portions among the one or more light-emitting portions driven thereby. Furthermore, after APC is executed and before the next image forming period, the CPU 401 executes BD interval measurement. By doing so, APC is executed symmetrically by the laser driver ICs in each laser beam scanning cycle. Accordingly, it is possible to further increase the degree to which the temperature properties of the driving circuits corresponding to $LD_1$ and $LD_8$ match, and to improve the accuracy of BD interval measurement.

Also, as shown in FIG. 12A, in each laser beam scanning cycle, the laser drivers 405A and 405B may execute APC in the following order: $LD_1$ and $LD_6$, $LD_3$ and $LD_6$, $LD_5$ and $LD_4$. That is to say, in each laser beam scanning cycle, APC is executed on light-emitting portions connected to the same terminals of the laser drivers 405A and 405B (FIGS. 10 and 11). By controlling the execution of APC in this way, it is possible to further increase the degree to which the temperature properties of the driving circuits corresponding to $LD_1$ and $LD_8$ match, and to further improve the accuracy of BD interval measurement.

Note that as shown in FIG. 12A, for a predetermined period (period 1203) after APC is executed and immediately before BD interval measurement is started, the laser drivers 405A and 405B may be controlled such that all of the light-emitting portions 301 to 308 are mandatorily switched to a non-light-emitting state. The predetermined period is set as a period for sufficiently reducing the temperatures of the driving circuits corresponding to the light-emitting portions 301 to 308, and for example, it is set to be 30 μs or more. Accordingly, it is possible to uniformly reduce the temperatures of the light-emitting portions 301 to 308 at the time of executing BD interval measurement. As a result, it is possible to further increase the degree to which the temperature properties of the driving currents corresponding to the light-emitting portions 301 and 308 ($LD_1$ and $LD_8$) match, and to further improve the accuracy of BD interval measurement.

Fourth Embodiment

The third embodiment described an example in which, for a predetermined period after APC is executed and immediately before BD interval measurement is started, the laser drivers 405A and 405B are controlled such that all of the light-emitting portions 301 to 308 are mandatorily switched to a non-light-emitting state, as shown in FIG. 12A. In the fourth embodiment, a modified example of such control will be described.

Figure 12B:
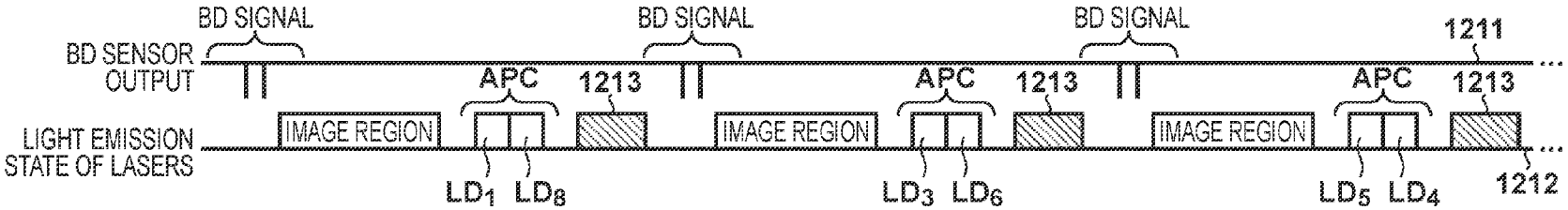

FIG. 12B is a timing chart showing the timing of operations performed by the optical scanning apparatus 104 according to the fourth embodiment. As shown in FIG. 12B, in the present embodiment, for a predetermined period (period 1213) after APC is executed and immediately before BD interval measurement is started, the laser drivers 405A and 405B are controlled such that all of the light-emitting portions 301 to 308 are mandatorily switched to a light emitting state. The predetermined period is set as a period that is sufficient for the temperatures of the driving circuits corresponding to the light-emitting portions 301 to 308 to enter a saturated state, and for example, it is set to be 30 μs or more. Accordingly, it is possible to uniformly saturate the temperatures of the light-emitting portions 301 to 308 at the time of executing BD interval measurement. As a result, it is possible to further increase the degree to which the temperature properties of the driving currents corresponding to the light-emitting portions 301 and 308 ($LD_1$ and $LD_8$) match, and to further improve the accuracy of BD interval measurement.

Figure 13:
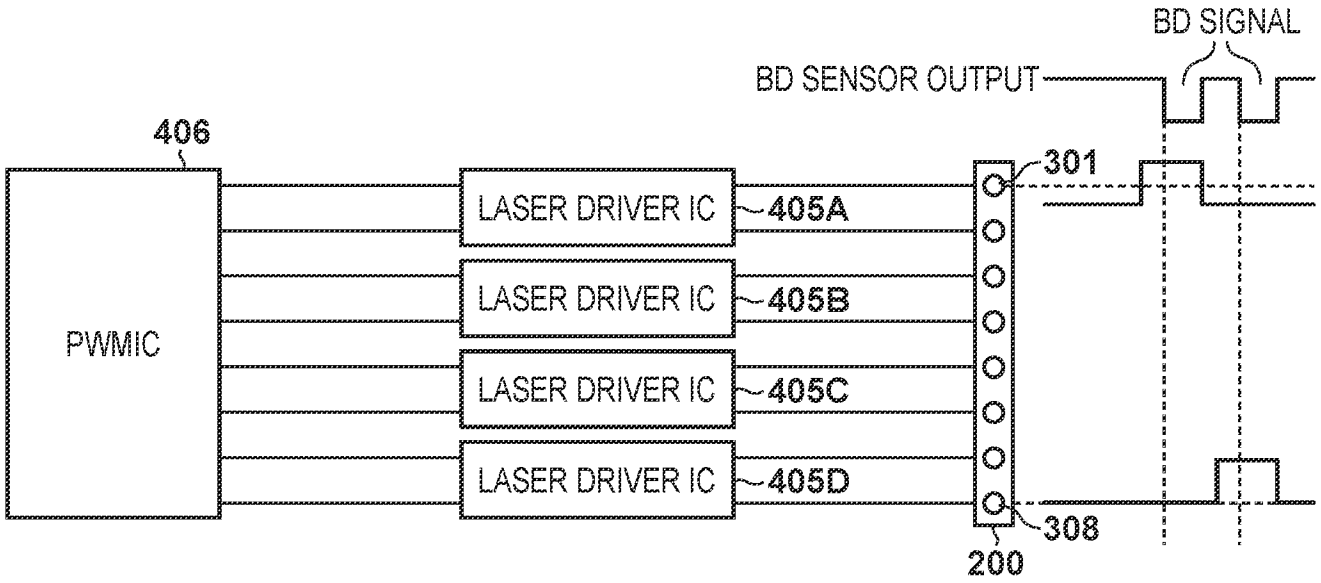
FIG. 13 is a diagram showing a modified example of a configuration of an optical scanning apparatus relating to BD interval measurement.

Note that the above-described embodiments are not limited to only the case where the optical scanning apparatus 104 includes two laser driver ICs (laser drivers 405A and 405B), and can be similarly applied also to the case where the optical scanning apparatus 104 includes three or more laser driver ICs. For example, as shown in FIG. 13, the optical scanning apparatus 104 may include four laser driver ICs (laser drivers 405A, 405B, 405C, and 405D). The above-described embodiments can be similarly applied to this type of case as well.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-077259, filed Apr. 3, 2014, which is hereby incorporated by reference herein in its entirety.

What is claimed is:

1. An image forming apparatus comprising:

a light source including a plurality of light-emitting portions that are each configured to emit a light beam for exposing a photosensitive member, wherein the plurality of light-emitting portions include a first light-emitting portion configured to emit a first light beam and a second light-emitting portion configured to emit a second light beam;

a deflection unit configured to deflect a plurality of light beams emitted from the plurality of light-emitting portions, such that the plurality of light beams scan the photosensitive member, wherein the first light beam deflected by the deflection unit exposes a different position from the second light beam deflected by the deflection unit in a scanning direction of the plurality of light beams;

a beam detection unit provided at a position on which a light beam deflected by the deflection unit is incident, the beam detection unit including a receiving surface configured to receive the first and second light beams deflected by the deflection unit, and being configured to generate a detection signal indicating that the light beam has been detected according to incidence on the receiving surface of the first and second light beams deflected by the deflection unit;

a first driver IC configured to drive light-emitting portions included in the plurality of light-emitting portions, wherein the light-emitting portions driven by the first driver IC include the first light-emitting portion;

a second driver IC configured to drive light-emitting portions that are included in the plurality of light-emitting portions and that are different from light-emitting portions driven by the first driver IC, wherein the light-emitting portions driven by the second driver IC include the second light-emitting portion; and a control unit, wherein the beam detection unit is configured to generate a first signal according to detection of a light beam emitted from a light-emitting portion driven by the first driver IC and to generate a second signal according to detection of a light beam emitted from a light-emitting portion driven by the second driver IC, and the first signal and the second signal are generated by the beam detection unit separately, and wherein the control unit is configured to measure a time interval between the first signal and the second signal, and is configured to control the first driver IC and the second driver IC so that with respect to relative emission timings at which the plurality of light-emitting portions emit light beams based on image data, the relative emission timings are controlled based on the measured time interval and by using as a reference a detection signal generated by the beam detection unit that has detected the first light beam.

2. The image forming apparatus according to claim 1, wherein the first driver IC and the second driver IC are integrated circuits having a same configuration, which each include driving circuits that respectively correspond to light-emitting portions to be driven and that respectively supply driving currents to different light-emitting portions.

3. The image forming apparatus according to claim 1, further comprising a light power detection unit configured to detect a light power of a light beam emitted from each of the plurality of light-emitting portions;

wherein the first driver IC is configured to control the light power of the light-emitting portions driven by the first driver IC so as to be a target value by controlling a driving current value according to the light power, detected by the light power detection unit, of the light beam emitted from the light-emitting portions driven by the first driver IC, and wherein the second driver IC is configured to control the light power of the light-emitting portions driven by the second driver IC so as to be a target value by controlling a driving current value according to the light power, detected by the light power detection unit, of the light beam emitted from the light-emitting portions driven by the second driver IC.

4. The image forming apparatus according to claim 1, wherein for a predetermined period immediately before the measurement of the time interval is started, the control unit controls the first driver IC and the second driver IC such that all of the plurality of light-emitting portions are mandatorily switched to a non-light-emitting state.

5. The image forming apparatus according to claim 1, wherein for a predetermined period immediately before the measurement of the time interval is started, the control unit controls the first driver IC and the second driver IC such that all of the plurality of light-emitting portions are mandatorily switched to a light emitting state.

6. The image forming apparatus according to claim 1, wherein the plurality of light-emitting portions driven by the first driver IC and the second driver IC are arranged linearly in one line in the light source, and a light-emitting portion which is disposed on one end of the plurality of light-emitting portions driven by the first driver IC and the second driver IC is driven by the first drive IC and a light-emitting portion which is disposed on another end of the plurality of light-emitting portions driven by the first driver IC and the second driver IC is driven by the second driver IC.

7. The image forming apparatus according to claim 1, wherein the light source is a vertical cavity surface emitting laser.

8. The image forming apparatus according to claim 1, further comprising:

the photosensitive member;

a charging unit configured to charge the photosensitive member; and a developing unit configured to develop an electrostatic latent image formed on the photosensitive member by exposure using the plurality of light beams so as to form, on the photosensitive member, an image that is to be transferred onto a recording medium.

9. The image forming apparatus according to claim 1, wherein the control unit measures the time interval by using a pair of the first signal and the second signal generated in one scanning period of the light beam deflected by the deflection unit.

10. The image forming apparatus according to claim 1, wherein the first driver IC is configured to drive a first plurality of light-emitting portions included in the light source, and the second driver IC is configured to drive all remaining ones of the light-emitting portions that are included in the light source and that are different from first plurality of light-emitting portions driven by the first driver IC.

11. The image forming apparatus according to claim 10, wherein the first and second driver ICs are configured to drive an equal number of light-emitting portions.

12. The image forming apparatus according to claim 1, wherein a width of the receiving surface in the scanning direction is narrower than an interval in the scanning direction between an exposure spot of the first light beam and an exposure spot of the second light beam.

* * * * *